US009895668B2

(12) United States Patent
Feke et al.

(10) Patent No.: US 9,895,668 B2
(45) Date of Patent: Feb. 20, 2018

(54) DISPERSION OF PARTICULATE CLUSTERS VIA THE RAPID VAPORIZATION OF INTERSTITIAL LIQUID

(75) Inventors: Donald L. Feke, Chesterland, OH (US); Ica Manas-Zloczower, Orange, OH (US); Marcio Rodrigo Loos, Blumenau/SC (BR); Michelle Sing, Cambridge, MA (US)

(73) Assignee: CASE WESTERN RESERVE UNIVERSITY, Cleveland, OH (US)

( * ) Notice: Subject to any disclaimer, the term of this patent is extended or adjusted under 35 U.S.C. 154(b) by 741 days.

(21) Appl. No.: 14/233,535

(22) PCT Filed: Jul. 19, 2012

(86) PCT No.: PCT/US2012/047342

§ 371 (c)(1),
(2), (4) Date: Feb. 12, 2014

(87) PCT Pub. No.: WO2013/013010

PCT Pub. Date: Jan. 24, 2013

(65) Prior Publication Data

US 2014/0148517 A1 May 29, 2014

Related U.S. Application Data

(60) Provisional application No. 61/572,681, filed on Jul. 20, 2011.

(51) Int. Cl.
*B01F 3/12* (2006.01)
*B02C 19/18* (2006.01)

(52) U.S. Cl.
CPC ..... *B01F 3/1207* (2013.01); *B02C 19/186* (2013.01)

(58) Field of Classification Search
CPC ..... B01F 3/1207; B02C 19/186
USPC ..... 516/32; 241/21, 23
See application file for complete search history.

(56) References Cited

U.S. PATENT DOCUMENTS 1,578,609 A 9/1924 Mason
2,024,611 A * 12/1935 Stutz ..... C09C 3/043 106/262
2,333,456 A * 11/1943 Wynn ..... B01F 11/0216 241/21
2,550,390 A * 4/1951 Stephanoff ..... B02C 19/063 110/106

(Continued)

OTHER PUBLICATIONS

Gopalkrishnan et al., "Investigating dispersion mechanisms in partially infiltrated agglomerates: Interstitial fluid effects", Powder Technology 156 (2005) 111-119 (Publ. online May 23, 2005, online @ www.sciencedirect.com).*

*Primary Examiner* — Daniel S Metzmaier
(74) *Attorney, Agent, or Firm* — Hudak, Shunk & Farine Co. LPA

(57) ABSTRACT

A process for dispersing agglomerates or clusters of particles utilizing pressure generated from volatilization of an interstitial liquid. More particularly, the method relates to infusing the particles with a first liquid, placing the infused particles in a second liquid or fluid having a higher boiling point than the first liquid and heating the composition to a temperature above the boiling point of the first liquid thereby resulting in breakage of the particles. Compositions including particles dispersed by interstitial liquid vaporization are also disclosed.

16 Claims, 5 Drawing Sheets

(56) References Cited

U.S. PATENT DOCUMENTS

| | | | | | |
|---|---|---|---|---|---|
| 2,560,807 | A * | 7/1951 | Lobo | B02C 19/18 | 159/24.1 |
| 4,369,351 | A * | 1/1983 | Massey | F24H 1/106 | 241/1 |
| 4,540,467 | A * | 9/1985 | Grube | C05F 9/02 | 134/17 |
| 5,102,055 | A * | 4/1992 | Buschmann | C03B 37/10 | 241/39 |
| 5,360,553 | A * | 11/1994 | Baskis | B01J 6/008 | 201/25 |
| 5,921,478 | A * | 7/1999 | Kamiwano | B01F 3/1207 | 241/15 |
| 6,190,731 | B1 | 2/2001 | Tecle | | |
| 6,716,525 | B1 | 4/2004 | Yadav et al. | | |
| 6,929,199 | B1 * | 8/2005 | Garg | C09K 3/1409 | 241/1 |
| 2010/0116142 | A1 * | 5/2010 | Versini | B65D 85/8043 | 99/295 |

* cited by examiner 0 seconds 10 seconds 20 seconds

DISPERSION OF PARTICULATE CLUSTERS VIA THE RAPID VAPORIZATION OF INTERSTITIAL LIQUID

CROSS REFERENCE

This Application claims the benefit of priority under 35 U.S.C. §119 of U.S. Provisional Application Ser. No 61/572,681, filed on Jul. 20, 2011, herein fully incorporated by reference.

FIELD OF THE INVENTION

The present invention relates to a process for dispersing agglomerates or clusters of particles utilizing pressure generated from volatilization of an interstitial liquid. More particularly, the method relates to infusing the particles with a first liquid, placing the infused particles in a second liquid or fluid having a higher boiling point than the first liquid and heating the composition to a temperature above the boiling point of the first liquid thereby resulting in breakage of the particles. Compositions including particles dispersed by interstitial liquid vaporization are also disclosed.

BACKGROUND OF THE INVENTION

The dispersion of clusters or solids is a common step in many chemical or material processing applications, and the ultimate quality and performance of systems incorporating fine particles is directly affected by the degree to which these clusters are dispersed. Hence, processing methods that achieve better dispersion results are critical for advancing materials processing and are constantly being sought by industry. Dispersion occurs when forces active on the length scale of the cluster or its constituent particles are sufficient in magnitude to overcome the cohesive forces binding the cluster together, see for example Manas-Zloczower, I. (Ed.), Mixing and Compounding of Polymers: Theory and Practice, Hanser publications, Cincinnati, 2009. The cohesivity of particles clusters can arise from van der Waals or electrostatic interactions between the individual particles, interactions between secondary chemical species (binders or surfactants) added to the cluster to augment the intrinsic interparticle interactions, or capillary forces associated with liquids present within the interstices of the cluster. In order to accomplish dispersion, external forces (e.g. hydrodynamic shear, or shock waves associated with the collapse of ultrasonically induced cavitation bubbles) can be applied to overcome the cohesive forces that bind the particle clusters together.

In common practice, dispersion is achieved in some embodiments by suspending particle agglomerates within fluids and subjecting them to agitation or shearing motions. The hydrodynamic stresses generated by the fluid motion exert forces that act on the periphery of the agglomerate to produce fragments. Dispersion by this method may require long processing times as the kinetics of the dispersion may be quite slow. In other cases, ultrasonic energy is applied to a suspension of the agglomerates with the hope that the shock waves associated with the collapse of cavitation bubbles fractures the agglomerates. In still other cases, the agglomerates are subjected to mechanical forces designed to compress and fracture the agglomerates. In the usual circumstance, these methods do not lead to complete dispersion, and large fragments, resistant to further degradation are produced. This limits the quality of the product into which the particles are incorporated. To remedy this less than optimal outcome, sometimes the agglomerates are subjected to chemical treatment (e.g. incorporation of fluids within the interstices of the agglomerate to weaken its cohesivity) prior to the dispersion attempt. However, the introduction of additional chemical species to the system can be expensive and can alter the properties and behavior of the final product.

A process known as explosive disintegration has previously been used as a way to reduce wood to splinters for use in particle board. The Masonite process, see for example R. M. Boehm, The Masonite process, Ind. Eng. Chem, 22 (1930), 493-497; B. Focher, A. Marzetti, V. Crescenzi (Eds.), Steam Explosion Techniques; Fundamentals and industrial Applications, Gordeon and Breach Science publishers, Amsterdam, 1991; and W. H. Mason, U.S. Pat. No. 1,578,609 involves fully permeating a piece of wood with moisture while it is under pressure at elevated temperature. When the pressure is suddenly dropped, the expanding vapors cause the wood to disintegrate into splinters. Other processes are used for production of gun-puffed cereals, wherein the conditions are controlled so that the solid structure is expanded. A related process is the production of popcorn. The steam contained within the kernel expands once the outer shell of the kernel can no longer contain the internal pressure (typically $9.3\times10^5$ Pa) which develops when the kernel is heated to around 177° C., see for example A. S. Tandjung, S. Janaswamy, R. Chandrasekaran, A. Aboubacar, A., B. R, Hamaker, Role of the pericarp cellulose matrix as a moisture barrier in microwaveable popcorn, Biomacromolecules, 6 (2005), 1654-1660.

In view of the above, it would be desirable to provide a process that results in the generation of forces within an agglomerate or cluster of particles that are of sufficient magnitude to result in a rapid and complete dispersion of the agglomerate or cluster of particles.

SUMMARY OF THE INVENTION

It is an object of the present invention to provide a method for the dispersion of agglomerates or clusters of particles driven by the pressure generated from the volatilization of a liquid infused in the particles.

Yet another object of the present invention is to provide a method for breaking or dispersing agglomerates or clusters of particles in the nanometer to millimeter size range into smaller agglomerates, clusters or constituent particles.

Still another object is to provide a method that provides for breakage of agglomerates or clusters of particles within a liquid or fluid medium.

Another object of the present invention is to provide a method for reducing the size of agglomerates or clusters of particles providing one or more of energy and time savings when compared to subjecting such particles to agitation, a shearing motion, or ultrasonic energy.

A further object of the present invention is to provide a process for dispersing agglomerates or clusters of particles including the steps of infusing the particles with a first liquid, placing the infused particles in a second liquid or fluid immiscible with the first liquid, the first liquid having a lower boiling point then the second liquid or fluid and heating the composition to a temperature above the boiling point of the first liquid in a suitable period of time thereby resulting in breakage of the particles.

Another object of the present invention is to provide dispersed agglomerates or clusters of particles having tailored particles sizes within a medium, wherein the dispersion is controlled by temperature.

In one aspect, a method for dispersing clusters of particles is disclosed, comprising the steps of infusing a cluster of particles with a liquid; and generating an internal force within the cluster of particles by heating the liquid infused in the particles above the boiling point of the liquid at a prevailing system pressure, thereby breaking the cluster of particles.

In another aspect, a method for dispersing clusters of particles is disclosed, comprising the steps of incorporating a liquid into a cluster of particles; placing the liquid-incorporated-particles in a fluid to form a mixture; and heating the mixture above a boiling point of the liquid within an effective period of time to reduce an average size of the cluster of particles.

BRIEF DESCRIPTION OF THE DRAWINGS

The invention will be better understood and other features and advantages will become apparent by reading the detailed description of the invention, taken together with the drawings, wherein.

DETAILED DESCRIPTION OF THE INVENTION

Figure 1A:
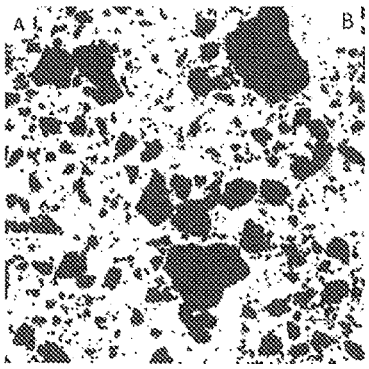
FIGS. 1A-1C are optical micrographs of the fragments produced from carbon black agglomerates infused with distilled water, processed at different temperatures: (A) 50° C.; (B) 80° C.; (C) 110° C., wherein the scale bar depicts 100 μm.

The methods of the present invention provide a vehicle for dispersing or breaking agglomerates or clusters of small particles, preferably in the nanometer to millimeter size range into even smaller agglomerates or clusters, or if possible constituent particles. The particle size is reduced without the need for external forces, such as, but not limited to, mixing, agitation, crushing and ultrasonic energy. However, such external forces can be used in some embodiments in addition to the methods of the present invention.

Agglomerates or clusters of particles are infused with a volatile liquid and are introduced to a medium such as a second liquid or a fluid that is maintained or raised to an elevated temperature, the medium being a substrate in which the particles are to be dispersed. The particles experience an increase in temperature and the incorporated liquid vaporizes thereby generating internal pressure within the particles. Under proper processing conditions, the temperature increase or heating rate is rapid enough so that the internal pressure is adequate to overcome the cohesivity of the particles, thereby producing multiple fragments and accomplishing dispersion.

The agglomerates or clusters of particles suitable for use in the invention are defined by various properties. They must contain at least one open pore for example, a pocket or cavity that can be accessed and thus be capable of being infused or infiltrated by at least one liquid. The particles must be capable of being encapsulated by a fluid such that the infused liquid substantially remains within the particles during a heating step of the method until internal pressure is generated from volatilization of the liquid and the particle is shattered, fractured, broken or the like into smaller particles. The particles can vary in size and shape and are preferably able to be well welled by the incorporated liquid. An additional requirement is that the particles are not substantially soluble in the infusing liquid. Also, the cohesive strength of the particle cluster is important and the vaporized liquid must be able to produce enough force to overcome the cohesivity of the cluster.

In view of the above, examples of suitable classes of particles include, but are not limited to, additives, fillers, pigments, and mechanical reinforcements. Specific examples of particles include carbon black and carbon nanotubes.

Average particle sizes of the agglomerates or clusters of particles prior to particle fracture range generally from the millimeter size down to the nanometer size. Results of experiments suggest that the larger the cluster of a particular material, the easier it is to demonstrate the effect.

As indicated herein, the agglomerates or clusters of particles are imbibed with a suitable liquid that is later vaporized or volatilized in order to reduce the size of the particles. Generally speaking the viscosity of the liquid to be infused in the particles is not limited so long as the liquid can be incorporated in the particles to a sufficient degree such that said liquid can later be vaporized or volatilized in order to reduce the particle size of the particles. Depending upon the liquid utilized, the amount of time it takes for the liquid to be absorbed into the particles can vary. Preferred liquids are absorbed into the agglomerates or clusters of particles relatively rapidly. As stated above, the liquid should not dissolve the particle. The liquid should vaporize at a temperature that does not cause substantial damage (melting or decomposition) of the particles.

Suitable liquids include, but are not limited to, water and acetone. There are hundreds of liquids that may be suitable. Any liquid that vaporizes (rather than decomposes) is a candidate. Two or more different liquids can be utilized to imbibe the agglomerates or clusters of particles prior to vaporization, with the liquids preferably having different boiling points. Multiple imbibing liquids can be used to produce a plurality of breakage events.

Multiple liquids are particularly suitable for incorporation into agglomerates or clusters of particles when the structure of particle clusters occurs on multiple levels, as can be typical for various types of particles. For example, individual particles can be associated into small agglomerates (e.g. 1-10 micron in size) and those small agglomerates can be granulated into larger clusters (~1 mm in size). Sometimes the large clusters are fashioned into a continuous paste. Clusters with even more levels of structure also exist. As an example of imbibing agglomerates or clusters of particles with multiple liquids, a cluster with two levels of structure is infiltrated with a liquid that vaporizes at 120° C., adding only enough of this first liquid such that it will infiltrate the pores of the small agglomerates within the larger cluster. Next, the cluster can be infiltrated with a second, different liquid that vaporizes at 100° C., in a quantity that fills the remaining large pores of the large agglomerate. Upon heating, when the temperature exceeds 100° C., the large agglomerate would break or otherwise "pop" apart as the 100° C. liquid vaporizes. This would produce a dispersion of the small agglomerates. Then, as heating continues and the temperature passes 120° C., the small agglomerates would also break, fracture or "pop" into even smaller fragments. Thus, using multiple infusing liquids allows for a series of "pops" to occur, thereby breaking the cluster down to smaller fragments than could be achieved by using a single infusing liquid.

In one embodiment the liquid is a relatively low boiling point solvent, for example having a boiling point that ranges generally from about 30° C. to about 200° C. and desirably from about 40° C. to about 150° C., preferably from about 50° C. to about 120° C. By utilizing a relatively low boiling point liquid, the amount of energy needed to be applied to raise the temperature of the medium to a temperature to allow fracture of the agglomerates or clusters of particles is relatively low. Additionally, in many applications, processing of agglomerates or clusters of particles will normally occur at elevated temperatures so that the present invention can take advantage of the thermal energy already present in such a process.

The medium into which the agglomerates or clusters of particles are to be dispersed can generally be any fluid, such as a liquid polymer melt or polymer solution which can be heated above the boiling point of the incorporated liquid without substantially degrading. Many of the intended media (e.g., polymers) may not even have a boiling point since they decompose prior to boiling. Examples of suitable media include, but are not limited to, oils such as mineral oils, and polymers.

The imbibing liquid can be incorporated into an agglomerate or cluster of particles in any suitable method. In one embodiment, the liquid is added to the particles. In a further embodiment the desired particles are immersed in the liquid for a suitable period of time such that a desired amount of the liquid is incorporated into the agglomerate or cluster of particles. Other methods can be used. For example, one can condense liquid into the particle cluster from its vapor.

Once the desired liquid has been incorporated into the particles, the particles are added to the desired medium thereby forming a mixture. In a preferred embodiment the media encapsulates the particles. The particles can be dispersed within the media by any suitable method, if desired, such as by mixing, stirring, agitation or the like. The fluid of mixture is either already above the boiling point of the liquid at the time of incorporation or heated above the boiling point of the liquid infused in the particles for a suitable period of time such that the liquid vaporizes or volatizes, fracturing or otherwise breaking the particles, thereby dispersing the smaller size particles within the media. The method of heating can vary. For example, convection and conduction heating can be utilized. In a further embodiment microwave heating can be utilized. The wetted particle cluster needs to be introduced in such a manner that the infused liquid does not vaporize and escape from the particle cluster prior to its complete submersion in the medium.

In other embodiments as mentioned hereinabove, the dispersion technique of the present invention can be used in combination with other dispersion techniques as known in the art. Depending on the additional technique utilized, the dispersion processes can be performed simultaneously or sequentially. For example, the present invention dispersion process using volatilization can be performed first, and a second technique, such as ultrasonication performed thereafter. Other suitable dispersion processes include, but are not limited to, agitation, attrition, crushing, grinding, mixing and ultrasonication.

EXAMPLES

Agglomerates of carbon black (Black Pearls 120 V-424 supplied by the Cabot Corporation) were used for the dispersion studies. Distilled water (boiling point=100° C.) or acetone (boiling point=56.5° C., supplied by Fisher Chemical) were used to wet the agglomerates. Light mineral oil (Fisher Chemical, Lot #101970) was used as the dispersion medium.

Spherical clusters of carbon black 2-2.5 mm in diameter were prepared and treated with the appropriate solvent. For experiments with distilled water, one drop of water was added to the carbon black cluster and its weight recorded. After allowing five minutes for the water to be absorbed into the cluster, excess water was removed by dabbing with tissue paper. For experiments with acetone, the weight was recorded after one drop was added. Additional drops of acetone were added at 60-s intervals, After the fifth drop of acetone was added, the excess liquid was absorbed using tissue paper.

Approximately 30 g of mineral oil was placed into a 150 mL beaker, which was equilibrated in heated oil bath set to various temperatures ranging to upwards of 50° C. higher than the boiling point of the infused liquid. Temperatures were controlled to within ±5° C. The wetted clusters of carbon black were placed in the mineral oil for 5 min, at which point the beaker was removed and allowed to cool for at least 30 min before the contents were analyzed. Table 1 provides details of the parameters used.

TABLE 1

| | Distilled Water | | | | |
|---|---|---|---|---|---|
| Relative T | T (° C.) | $P_{vap}$ (Pa) | Oil (g) | CB (mg) | DW (mg) |
| Room | 22 | $2.64 \times 10^3$ | 30.36 | 4.5 | 16.1 |
| $T_b$ − 50° C. | 50 | $1.24 \times 10^4$ | 31.58 | 5 | 14.6 |
| $T_b$ − 20° C. | 80 | $4.74 \times 10^4$ | 32.65 | 3.7 | 13.6 |
| $T_b$ + 10° C. | 110 | $1.40 \times 10^5$ | 31.69 | 4.8 | 17.3 |
| $T_b$ + 50° C. | 160 | $4.74 \times 10^5$ | 32.05 | 3.9 | 14.8 |
| | Acetone | | | | |
| Relative T | T (° C.) | $P_{vap}$ (Pa) | Oil (g) | CB (mg) | Acetone (mg) |
| Room | 22 | $2.69 \times 10^5$ | 32.72 | 3.3 | 37.6 |
| $T_b$ − 10° C. | 45 | $6.81 \times 10^5$ | 30.34 | 4.2 | 51.8 |
| $T_b$ + 10° C. | 65 | $1.36 \times 10^5$ | 33.68 | 7.2 | 65.2 |
| $T_b$ + 30° C. | 85 | $2.49 \times 10^5$ | 31.02 | 5.3 | 55.9 |

Figure 1B:
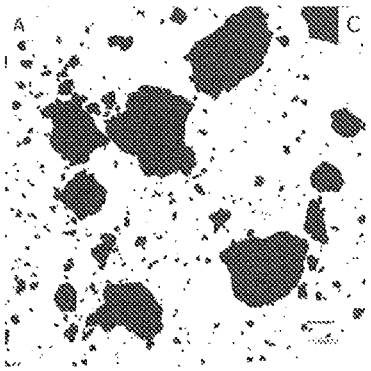
Figure 1C:
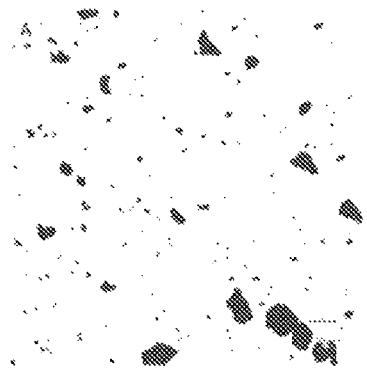

Images of the results of the dispersion experiments were obtained using an Olympus BX51 Optical Microscope, see FIG. 1 for example. A micropipette (having an enlarged tip) was used to transfer the contents from the dispersion to glass slides. At least three, and usually six, slides were made per experiment. In order to get a good representation of the fragment size distribution, 6-15 images were taken at different locations on each slide. MATLAB code was written to analyze the images. Each image was converted to an 8-bit grayscale image and the individual area of the each fragment was then used to find the equivalent diameter, assuming each fragment to be approximately spherical. These results were then used to produce histograms of the fragment size distributions.

In order for this approach to lead to successful dispersion, it is important that the infused liquid remains within the cluster during the heating period. The possibility that the infused liquid could be forced out of the carbon black cluster was investigated by placing a drop of the mineral oil onto the wetted carbon black cluster. In this case, the oil encapsulated the cluster, trapping the water inside. This encapsulation is believed to be useful in enhancing the pressurization that could occur within the carbon black cluster, and is therefore useful in improving the dispersion effect.

All carbon black clusters treated with distilled water showed some dispersion upon simply being placed within the mineral oil. However, there was a visible difference between the experiments performed at temperatures below and above the boiling point of water. Agglomerates processed above 100° C. appeared to explode, and for trials performed well above the boiling point, there were audible popping sounds immediately after the agglomerate was dropped into the heated oil. FIG. 1 shows representative images of the fragments produced at three different operating temperatures.

For trials in which acetone was used, there was also some minor erosion associated with dropping the sample into the oil. Here too, there was an appreciable difference between experiments performed about the boiling point of acetone. However, large differences were not seen until a temperature of 85° C., (30° C. above the boiling point) was tested. As was the case with the water-infused agglomerates, the quantity and size of large fragments decreased with increased processing temperature.

Figure 2A:
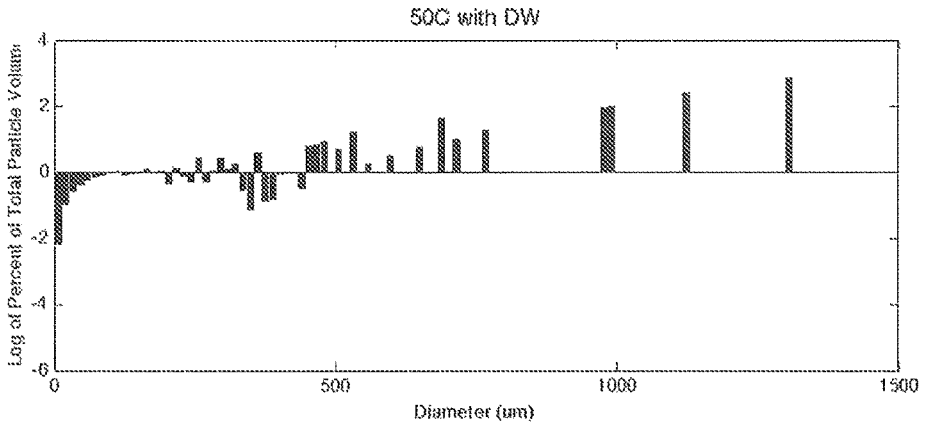
FIGS. 2A-2C are graphs illustrating volume size distribution vs. fragment diameter for water-infused carbon black agglomerates processed at (A) 50° C.; (B) 110° C.; (C) 150° C., wherein the decrease in frequency of large fragments at the elevated temperature can be noted.
Figure 2B:
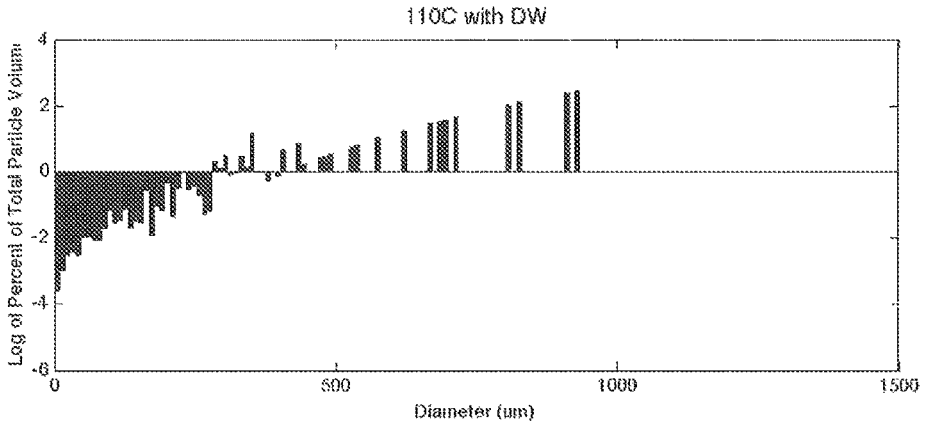
Figure 2C:
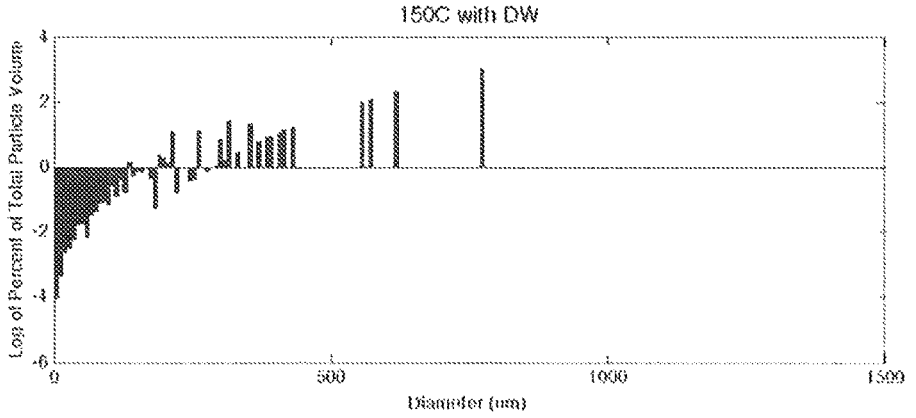
Figure 3A:
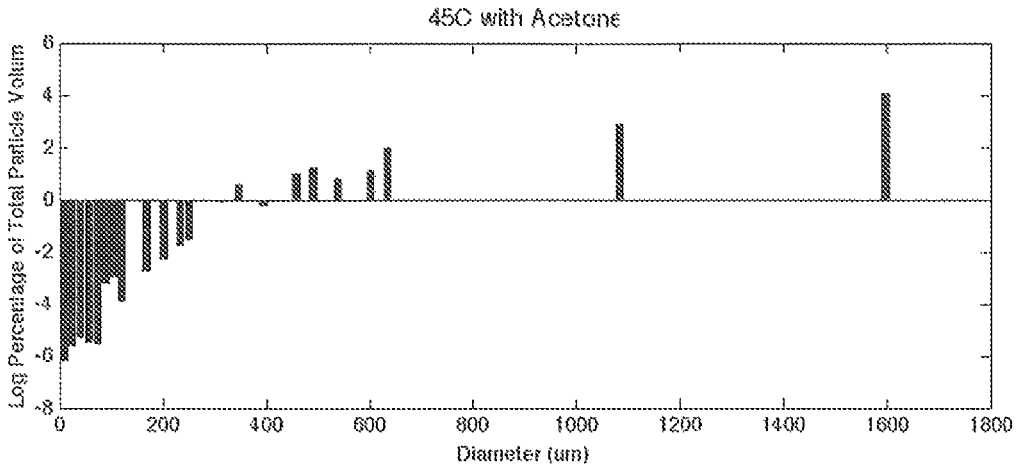
FIGS. 3A-3C are graphs illustrating volume size distribution vs. fragment diameter for acetone-infused carbon black agglomerates processes at (A) 45° C.; (B) 65° C.; (C) 85° C.
Figure 3B:
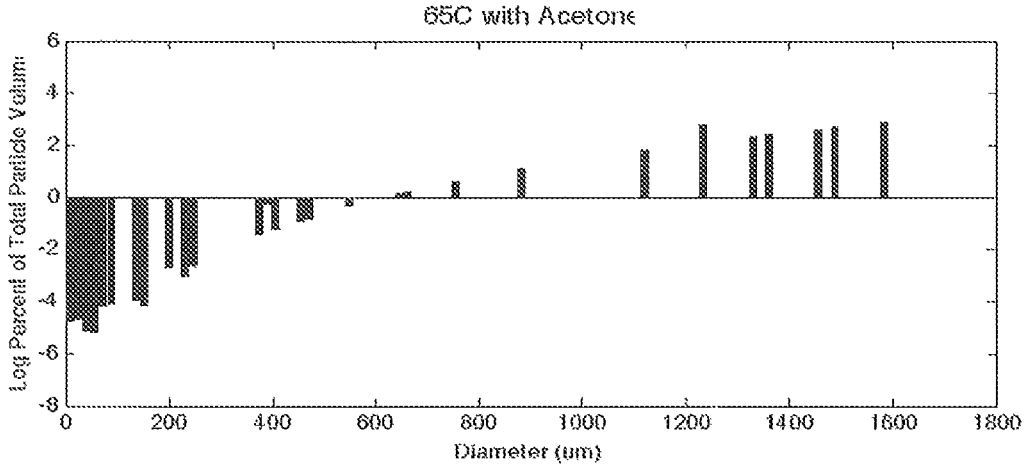
Figure 3C:
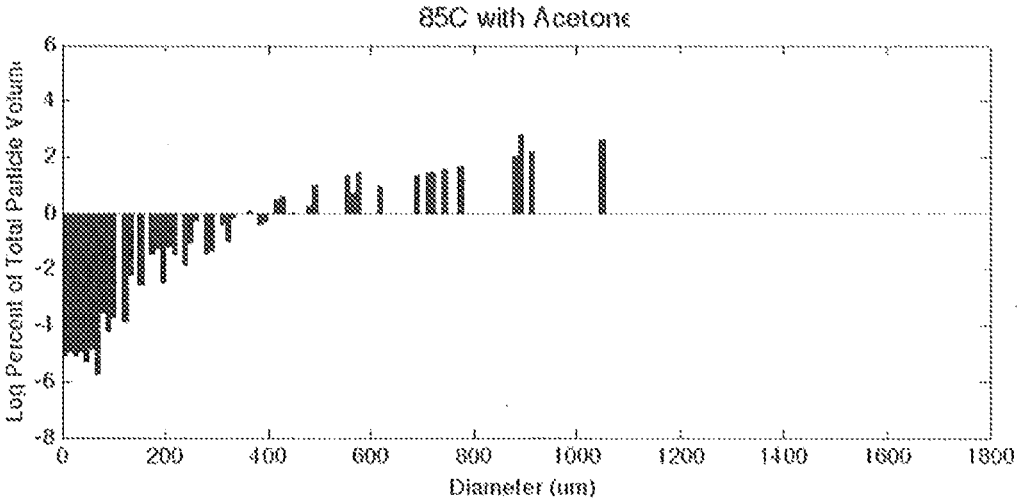

Normalized fragment size distributions were computed from the microscopy images. FIGS. 2 and 3 show the results for the dispersion of water-infused and acetone-infused carbon black agglomerates obtained at various processing temperatures. Note the production of greater quantities of small fragments, and the reduction in the number of large fragments, as the processing temperature was increased.

The difference in behavior seen for the water-infused and acetone-infused carbon black agglomerates can be attributed to the different effects of the two liquids on the cohesivity of the cluster. For the case of water, the cohesivity is apparently reduced to the point where less internal pressure is needed to break the cluster. For example, comparison of the results from processing at 10° C. above the boiling point for the two liquids (i.e., 110° C. for water, 65° C. for acetone) which produces similar internal pressures (see Table 1) in the two cases, show that there are fewer large fragments for the case of water.

Figure 4:
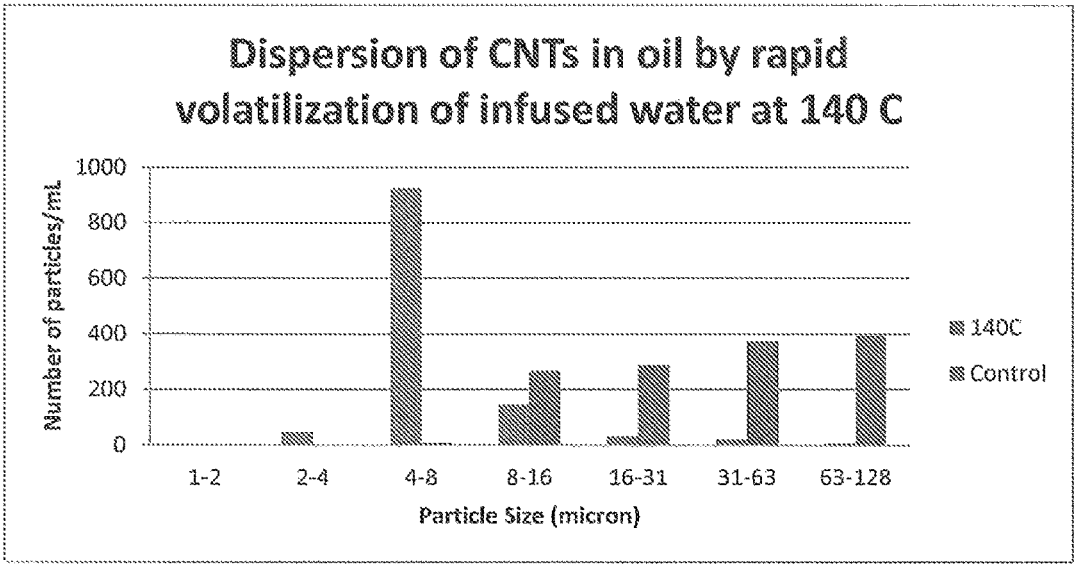
FIG. 4 is a graph illustrating fragment size distribution between water-infused CNT agglomerates heated in an oil bath at 140° C. compared to a control sample immersed in an oil bath at room temperature.

To further demonstrate the method, water-infused CNT agglomerates were heated in an oil bath at 140° C. to induce the rapid evaporation of the incorporated water, which resulted in breakage of the cluster. The resulting fragment size distribution was contrasted with the size distribution of a control sample immersed in the oil bath at room temperature. The attached FIG. 4 shows preliminary and non-optimized, yet very promising results.

Figure 5:
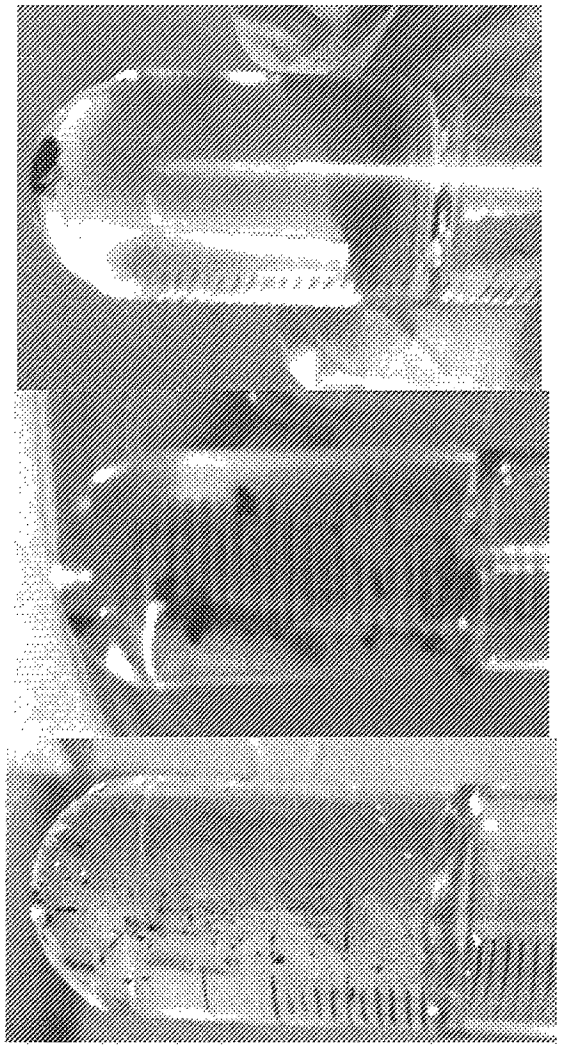
FIG. 5 illustrates a time series of images showing the results of microwave heating of water-infused CNT agglomerates.

In another demonstration, instead of direct heating of the suspending oil to drive the rapid volatilization of the interstitial fluid within the CNT agglomerates, microwave energy was applied. Microwave radiation is very efficiently absorbed by both water and CNTs, and the localized heating of the CNT agglomerates produces the desired effect. FIG. 5 is a time series of images showing the result of microwave heating of water-infused CNT agglomerates.

The ability to accomplish the dispersion of particle agglomerates via the rapid evaporation of an incorporated liquid has been demonstrated. Dispersion results demonstrated that the number of large fragments diminished when the agglomerate or clusters of particles were processed at temperatures that exceeded the boiling point of the incorporated liquid.

In accordance with the patent statutes, the best mode and preferred embodiment have been set forth, the scope of the invention is not limited thereto, but rather by the scope of the attached claims.

What is claimed is:

1. A method for dispersing clusters of particles, comprising the steps of:

infusing a cluster of particles with a liquid; and generating an internal force within the cluster of particles by heating the liquid infused in the particles above the boiling point of the liquid at a prevailing system pressure and at a rate rapid enough to break the cluster of particles, wherein prior to said generating the internal force within the cluster of particles step, the infused cluster of particles is introduced into a dispersion medium immiscible with the liquid, wherein the dispersion medium can be heated above the boiling point of the liquid infused in the cluster of particles without substantially degrading, wherein the dispersion medium comprises one or more of an oil and a polymer, wherein the liquid infused in the cluster of particles comprises one or more of water and acetone, and wherein the particles comprise one or more of carbon black and carbon nanotubes.

2. The method according to claim 1, wherein the particles comprise an additive, a filler, a pigment, a mechanical reinforcement, or a combination thereof, and wherein the cluster of particles has a size that ranges from a nanometer to a millimeter.

3. The method according to claim 1, wherein the liquid is a low boiling point solvent having a boiling point that ranges from about 30° C. to about 200° C.

4. The method according to claim 3, wherein the infused liquid has a boiling point of from about 40° C. to about 150° C.

5. The method according to claim 1, wherein the dispersion medium encapsulates the cluster of particles, wherein said infusing step includes one or more of adding the liquid to the cluster of particles, immersing the particles in the liquid and condensing the liquid into the cluster of particles from a vapor, and wherein said heating comprises direct heating or application of microwave energy.

6. The method according to claim 1, further including the steps of subjecting the particles to one or more of agitation, attrition, crushing, grinding, mixing, and ultrasonication.

7. The method according to claim 1, wherein said liquid comprises two or more different liquids.

8. A method for dispersing clusters of particles, comprising the steps of:

incorporating a liquid into a cluster of particles;

placing the liquid-incorporated-cluster of particles in a fluid immiscible with the liquid to form a mixture; and heating the mixture above a boiling point of the liquid within an effective period of time to reduce an average size of the cluster of particles, wherein the fluid immiscible with the liquid can be heated above the boiling point of the liquid without substantially degrading, wherein the liquid has a boiling point of from about 40° C. to about 150° C., wherein the fluid immiscible with the liquid comprises one or more of an oil and a polymer, wherein said liquid comprises one or more of water and acetone, and wherein said particles comprise carbon black and carbon nanotubes.

9. The method according to claim 8, wherein the boiling point of the liquid ranges from about 30° C. to about 200° C., and wherein the average size of the cluster of particles ranges from a nanometer to a millimeter.

10. The method according to claim 9, wherein the particles comprise an additive, a filler, a pigment, a mechanical reinforcement, or a combination thereof.

11. The method according to claim 10, wherein during the heating step, the liquid incorporated into the cluster of particles vaporizes thereby generating internal pressure to reduce the average size of the cluster of particles.

12. The method according to claim 10, wherein the fluid immiscible with the liquid encapsulates the cluster of particles, and wherein said incorporating step includes one or more of adding the liquid to the cluster of particles, immersing the cluster of particles in the liquid or condensing the liquid into the cluster of particles from a vapor.

13. The method according to claim 9, wherein said liquid comprises two or more different liquids.

14. The method according to claim 9, wherein the heating step comprises utilization of convection heating, conduction heating, or microwave energy, or a combination thereof.

15. The method according to claim 8, wherein the method further includes the step of subjecting the mixture to one or more of agitation, attrition, crushing, grinding, mixing, and ultrasonic energy.

16. The method according to claim 8, wherein the incorporating step results in forming a continuous paste comprising the liquid and the cluster of particles.

* * * * *